United States Patent [19]

Parish

[11] 4,386,668

[45] Jun. 7, 1983

[54] SEALED LUBRICATED AND AIR COOLED ROCK BIT BEARING

[75] Inventor: Verble W. Parish, Houston, Tex.

[73] Assignee: Hughes Tool Company, Houston, Tex.

[21] Appl. No.: 188,443

[22] Filed: Sep. 19, 1980

[51] Int. Cl.[3] ..... E21B 10/22

[52] U.S. Cl. ..... 175/228; 384/94

[58] Field of Search ..... 175/228, 371, 372; 308/8.2

[56] References Cited

U.S. PATENT DOCUMENTS

| | | | |
|---|---|---|---|
| 1,909,128 | 5/1933 | Scott et al. | 175/228 |
| 2,814,465 | 11/1957 | Green | 175/228 |
| 2,906,504 | 9/1959 | Parks | 175/228 |
| 3,048,230 | 8/1962 | Angel | 175/228 |
| 3,244,459 | 4/1966 | Ortloff | 308/8.2 |
| 3,251,634 | 5/1966 | Dareing | 308/8.2 |
| 3,845,994 | 11/1974 | Trey | 308/8.2 |
| 3,921,735 | 11/1975 | Dysart | 175/337 |
| 4,183,416 | 1/1980 | Walters | 175/228 |
| 4,194,794 | 3/1980 | Kling | 308/8.2 |
| 4,274,498 | 6/1981 | Penny | 175/228 |

*Primary Examiner*—James A. Leppink

*Attorney, Agent, or Firm*—Robert A. Felsman; James E. Bradley

[57] ABSTRACT

An earth boring bit has features particularly for use in drilling holes in which compressed air is used as a drilling fluid. The bit has three rotatable cutters, each having a cavity for mounting on a depending bearing pin. The cutter and the bearing pin have a thrust bearing in the lower portion of the cavity and a roller bearing in the upper portion of the cavity. The bit has air passages for discharging through the roller bearing gaseous fluid pumped from the surface. A seal seals the nose area from the roller bearing area. Liquid lubricant is located in the nose area for lubricating the bearing surfaces in this portion of the bit. A lubricant chamber is in communication with the nose area. The lubricant chamber cavity has a sliding piston for applying pressure to the lubricant. The sliding piston is driven by the compressed air in the air passages.

6 Claims, 4 Drawing Figures

SEALED LUBRICATED AND AIR COOLED ROCK BIT BEARING

BACKGROUND OF THE INVENTION

This invention relates in general to earth boring bits and in particular to an improved bearing for an earth boring bit used in gaseous fluid drilling.

In certain types of mining, shallow holes approximately 50 foot deep are drilled for receiving explosives. Typically a rotary rock bit is used of the type having three rotatable conical cutters, each having earth disintegrating teeth, such as shown in U.S. Pat. No. 3,921,735. Each cutter has a cavity for mounting on a depending bearing pin. A thrust bearing is located at the bottom of the cavity for transmitting axial thrust along the bearing pin. A radial load bearing is located in the lower or nose portion of the cavity and another at the outer or entrance of the cavity for transmitting radial forces to the bearing pin. The outer radial load bearing comprises cylindrical roller bearings.

Air is pumped through the drill pipe and through passages in the drill bit to the bearings for cooling and for keeping the bearings clean. While air cools the outer roller bearings adequately, air cooling does not work as well in the nose area of the bit. The thrust bearing is a frictional bearing instead of a rolling contact bearing. Also there is less space in the nose area through which air can pass. Consequently, the bearing surfaces in the nose area may eventually overheat, resulting in excessive wear and early failure.

In deep well drilling, the bearings are sealed and lubricated by grease. The drilling fluid that discharges into the borehole is a liquid. A pressure compensator in the drill bit reduces the pressure differential between the sealed bearing areas and the borehole. This type of bit is not suitable for drilling with air as the drilling fluid.

SUMMARY OF THE INVENTION

In this invention, the bearings between the cutter and the bearing pin are divided into two areas. The inner or nose area is filled with a liquid lubricant and sealed. The outer or roller bearing area has air passages for discharging air through the roller bearings for cooling. A lubricant cavity is in communication with the nose area. The lubricant cavity is pressurized, preferably by a piston that is acted on by the compressed air that is being pumped through the bit. A pressure relief valve relieves pressure in the lubricant chamber if heat causes the pressure to rise above a selected maximum.

DESCRIPTION OF THE PREFERRED EMBODIMENT

Figure 1:
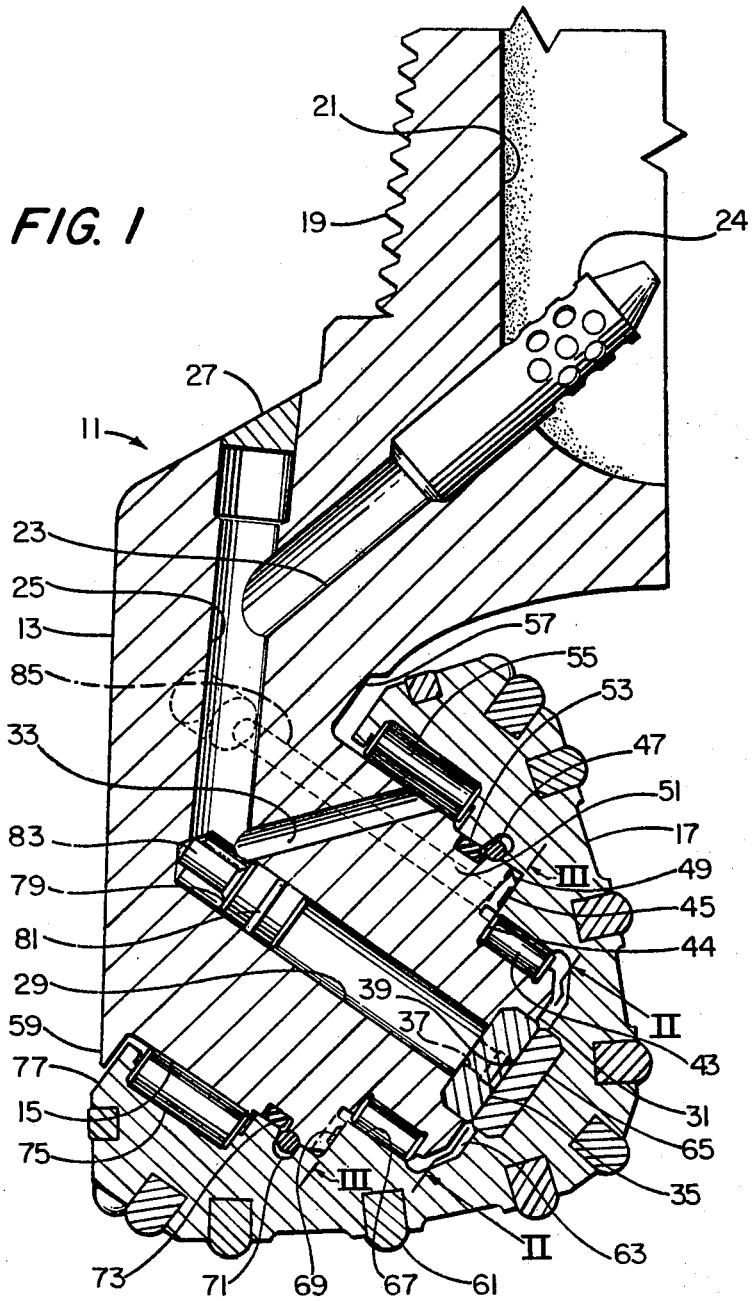
FIG. 1 is a vertical, partial sectional view, of a portion of an earth boring bit constructed in accordance with this invention.

Referring to FIG. 1 earth boring bit 11 has three head sections 13 (only one shown), each having a depending bearing pin 15. A generally conical shell or cutter 17 is mounted on each bearing pin 15. After cutter 17 has been assembled on bearing pin 15, the three head sections 13 are welded together. Threads 19 are formed on the upper end for securing to a lower end of a string of drill pipe.

Drill bit 11 has an axial passage 21. Nozzles (not shown) are in fluid communication with the bottom of the axial passage 21 for discharging into the borehole a gaseous fluid pumped from the surface, normally compressed air. Some of the compressed air is diverted down air passage means for supplying air to the bearings between the bearing pin 15 and cutter 17. The air passage means includes an inclined passage 23 connected to axial passage 21 and containing a filter 24 for filtering particles from the air. A water separator (not shown) is located at the top of axial passage 21 for separating contaminents and moisture from the air. A water separator is shown in allowed and commonly owned U.S. patent application Ser. No. 921,700 filed July 3, 1973, invented by Dolezal et al., this material being incorporated by reference.

The air passage means also includes a vertical passage 25 extending through the head section 13 and intersected by passage 23. A plug 27 seals the top of vertical passage 25. A passage 29 that is coaxial with the axis of the bearing pin 15 intersects vertical passage 25. Passage 29 serves as a lubricant chamber and extends out the nose end 31 of the bearing pin 15. One or more passages 33 extend from a point where passage 29 intersects passage 25 to a cylindrical portion of the bearing pin 15.

Figure 2:
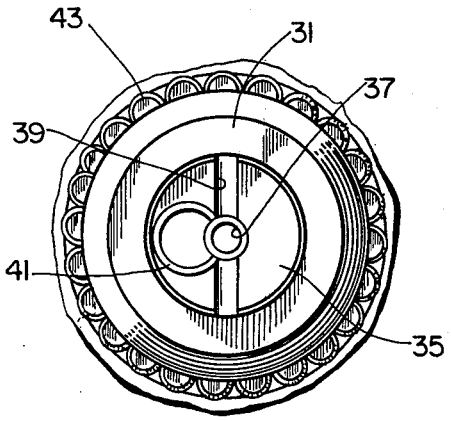
FIG. 2 is a sectional view of the bit of FIG. 1, taken along the lines II—II of FIG. 1.
Figure 3:
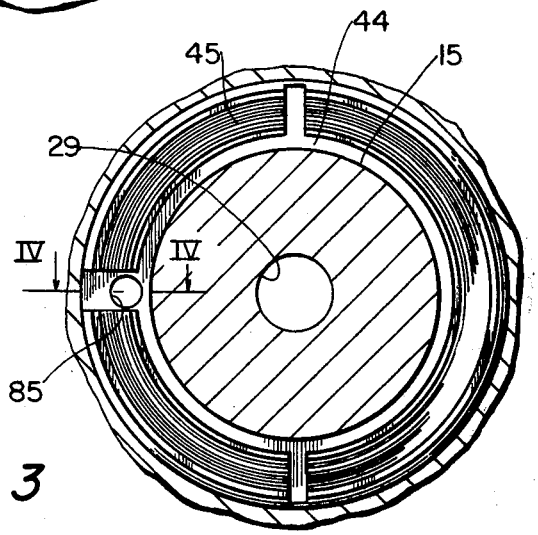
FIG. 3 is a sectional view of the bit of FIG. 1, taken along the lines III—III.

A thrust button 35 is mounted in the circular nose end 31 of the bearing pin 15. Thrust button 35 is of hard, wear resistant metal. As shown also in FIG. 2, thrust button 35 is circular and has a hole 37 passing through it for the passage of lubricant from the lubricant chamber 29. A linear channel or slot 39 formed in the face of thrust button 35 allows communication of the lubricant outside of the thrust button 35. As shown in FIG. 2, a semicircular groove 41 filled with a silver alloy and located in thrust button 35, provides additional wear resistance.

Referring again to FIG. 1, the bearing pin has a reduced diameter cylindrical portion located at the nose end 31 that has a race for receiving a radial load bearing. In this embodiment, the load bearing comprises a plurality of cylindrical roller bearings 43. A bushing such as shown in U.S. Pat. No. 4,194,794 or other type of friction bearing may also be acceptable. The roller bearings 43 abut on their outer ends against a circular shoulder 44. Circular shoulder 44 has a groove 45 containing hard, wear resistant metal, preferably a cobalt based alloy of the Stellite series. A circular snap ring 47 is located in a shallow groove immediately outward from the shoulder containing groove 45. Snap ring 47 is sized so that it squeezes or exerts a compressive force on bearing pin 15. A bevel 49 at the outer edge of shoulder 44 facilitates the insertion of the snap ring 47 over bearing pin 15. Snap ring 47 serves as a retaining means for retaining the cutter 17 on the bearing pin 15, and is of a type as described in allowed and commonly owned U.S. patent application Ser. No. 6,706, filed Jan. 26, 1979, invented by Galle, all of which material is hereby incorporated by reference.

The groove in bearing pin 15 that contains the snap ring 47 appears as slightly more than one fourth of a circular segment when viewed in a transverse sectional plane, as shown in FIG. 1. The outer edge of the groove for snap ring 47 leads into a circular channel 51 that is rectangular in cross section and formed in the bearing pin 15 in a plane perpendicular to the axis of bearing pin 15. An O-ring 53 is located in channel 51. O-ring 53 is a conventional toroid shaped ring of resilient organic material of a rubberlike nature such as neoprene. The depth and width of the channel 51 and the dimensions of O-ring 53 are selected so that the O-ring 53 will have a cross sectional squeeze of about 17% when cutter 17 is assembled. The use of an O-ring as a seal for fully sealed drill bit bearings is taught in U.S. Pat. No. 3,397,928.

A cylindrical bearing race is formed outward from the channel 51 for receiving a plurality of cylindrical roller bearings 55. An arcuate slot 57 is formed at the intersection of the bearing pin 15 with the head section 13 on the upper side. On the lower outer end of the head section 13, a shirttail 59 depends downwardly.

Cutter 17 has a generally conical exterior containing a plurality of cutting elements or teeth. In the preferred embodiment, the cutting elements are sintered tungsten carbide inserts 61, interferingly secured in mating holes formed in the exterior of the cutter 17. Cutter 17 has a depression or cavity 63 formed in its interior for reception on the bearing pin 15. A thrust button 65 is of hard, wear resistant material and has a face that is normal to the axis of the bearing pin 15 for mating with the face of the thrust button 35 in frictional contact. Cavity 63 has a circular race 67 formed for receiving the roller bearings 43. A shoulder 69 is formed in cavity 63 in a plane normal to the axis of bearing pin 15 for frictional contact with the groove 45 of shoulder 44.

A groove 71 is formed opposite the snap ring 47 for receiving the snap ring 47. Groove 71 is cut equal to or deeper than the diameter of snap ring 47 to enable the cutter 17 to be pushed over the bearing pin 15. Also, as taught in the above mentioned Galle patent application, the outer side of groove 71 is inclined 15° degrees with respect to the inner side of groove 71 for transmitting any inward thrust imposed on the cutter 17. Cavity 63 has a cylindrical portion 73 that engages O-ring 53 in sliding contact, and also compresses O-ring 53 as previously discussed. A race 75 is formed in a groove in the outer portion of the cavity 63 for receiving the roller bearings 55. The cutter 17 has a backface 77 that is circular, surrounds the entrance to cavity 63, and is spaced inward from the slot 57 a selected distance. The entrance to cavity 63 is greater in diameter than bearing pin 15 to provide a clearance for discharging air. The clearance between slot 53 and backface 77 is greater than the clearance between the inner face of shirttail 59 and backface 77. This difference permits air to discharge through slot 57 even if inward thrust wear has caused backface 77 to contact the inner face of shirttail 59.

A piston 79 is slidably carried within the lubricant chamber 29. Piston 79 is cylindrical and has an O-ring 81 for sealing lubricant from the drilling fluid. A neck 83, formed on the outer end of piston 79, extends outward for contacting the outer end of the lubricant chamber 29 when the piston 79 is in its outermost position. Piston 79 serves as pressure means for applying pressure in the lubricant chamber 29 greater than atmospheric.

Figure 4:
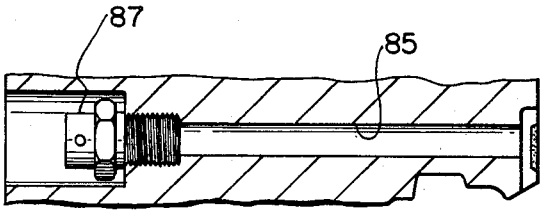
FIG. 4 is a view of the bit of FIG. 1, taken along the lines IV—IV of FIG. 3.

Referring also to FIG. 4, a relief passage 85 extends from shoulder 44 to the exterior. A pressure relief valve 87 is secured in the outer end of the relief passage 85 by threads. Relief valve 87 is of a type for allowing lubricant to be expelled to relieve pressure if the pressure exceeds about 275 psi (pounds per square inch) inside the lubricant chamber 29. Relief passage 85 does not intersect any of the air passages 23, 25 or 33, nor the lubricant chamber 29.

To assemble the bit, the snap ring 47 will be placed inside its recess 71. Roller bearings 43 and 55 will be placed in the races 67 and 75, respectively. O-ring 53 will be placed in its channel 51. Then the cutter 17 is pressed outward over the bearing pin 15 until snap ring 47 springs into the groove provided in the bearing pin 15. At this time the thrust buttons 35 and 65 will be in substantial contact with each other. The three head sections 13, thus assembled, will be welded together, then threads 19 will be formed.

Then, before pressure relief valve 87 is placed in passage 85, a nozzle (not shown) is connected to relief passage 85. The nozzle is connected to a vacuum pump, which evacuates substantially all of the air and gases in the inner bearing area, inward from O-ring 73. Piston 79 will be drawn to the extreme inward position, in contact with thrust button 35. While retaining the vacuum, degassed lubricant is then introduced through the nozzle and pumped into the inner bearing area to a selected pressure to assure complete filling. This will push the piston 79 to the outermost position, as shown in FIG. 1. Then the nozzle of the vacuum pump is removed, and the pressure relief valve 87 inserted, with the lubricant pressure being at ambient.

When assembled, O-ring 53 divides the bearing areas into an inner or nose bearing area containing lubricant and an air cooled outer bearing area containing roller bearings. O-ring 53 serves as a seal means for preventing air pumped from the surface from contacting lubricant in the nose bearing area.

In operation, the bit 11 is threaded into a drill pipe member, then lowered into the hole. The drill pipe is rotated, causing each cutter 17 to rotate about the axis of each bearing pin 15. Air at about 30 to 45 psi is pumped down the drill pipe, through axial passage 21 and out the nozzles (not shown) for moving cuttings to the surface. Some of the air will flow through filter 24, and air passages 23, 25 and 33. Air passage 33 discharges into the race 75, passes between the rollers 55 and out through clearances between the entrance of the cutter cavity 63 and the bearing pin 15 .

Compressed air will also act against the piston 79, pressurizing the lubricant in the lubricant chamber 29 and in the nose area. Heat generated because of the rotation of cutter 17 will cause the temperature of the lubricant to increase. Trapped gasses will expand, causing the pressure to increase. The piston, once its neck 83 contacts the end of the lubricant chamber 29, cannot move further outward to increase the volume of the lubricant chamber. If the pressure reaches a sufficiently high amount, such as 275 psi, lubricant will be expelled out the pressure relief valve 87 to avoid damaging the O-ring seal 53. As lubricant is depleted, the piston 79 will move inward toward button 35, decreasing the volume of the reservoir and maintaining positive pressure in the nose area. The air pressure on the opposite side of piston 79 will cause the movement of the piston. Piston 79 will move axially to the pressure differential across it, which will vary due to axial cutter movement, temperature increase, and variations in the air pressure. In this manner, piston 79 serves as a compensator means for limiting pressure differential between the air passages and the lubricant chamber 29.

The invention has significant advantages. The outer roller bearings are cooled in an efficient manner by air pressure. The radial and the thrust bearings in the nose area are lubricated by a liquid lubricant. This results in better lubrication of the various areas in the bearing. Positive pressure maintained on the lubricant reduces the tendency for the lubricant to crack into lighter components because of increased temperature. The O-ring seal is located on the inner side of the outer roller bearings, protecting the seal from cuttings and shirttail breakage damage.

While the invention has been shown in only one of its forms, it should be apparent that it is not so limited but is suceptible to various changes and modifications without departing from the spirit of the invention.

I claim:

1. In an earth boring bit of the type having at least one rotatable cutter with a cavity for mounting on a depending bearing pin, the cutter and the bearing pin having an inner bearing area in an inner portion of the cavity and an outer bearing area containing roller bearings in an outer portion of the cavity, the improvement comprising:

air passage means for discharging through the outer bearing area gaseous fluid pumped from the surface; and seal means for sealing the inner bearing area from the gaseous fluid in the outer bearing area, the inner bearing area being filled with liquid lubricant.

2. In an earth boring bit of the type having at least one rotatable cutter with a cavity for mounting on a depending bearing pin, the cutter and the bearing pin having a thrust bearing in an inner portion of the cavity and a set of roller bearings in an outer portion of the cavity, the improvement comprising:

air passage means for discharging through the roller bearings in the outer portion gaseous fluid pumped from the surface;

seal means mounted between the bearing pin and the cutter for preventing the gaseous fluid from reaching the thrust bearing;

a lubricant chamber containing lubricant and formed in the bearing pin in communication with the thrust bearing; and pressure means for applying pressure in the lubricant chamber greater than atmospheric.

3. In an earth boring bit of the type having at least one rotatable cutter with a cavity for mounting on a depending bearing pin, the cutter and the bearing pin having a thrust bearing in an inner portion of the cavity and a set of roller bearings in an outer portion of the cavity, the improvement comprising:

air passage means for discharging through the roller bearings in the outer portion gaseous fluid pumped from the surface;

seal means between the bearing pin and the cutter for preventing the gaseous fluid from reaching the thrust bearing;

a lubricant chamber containing lubricant and formed in the bearing pin in communication with the thrust bearing, the lubricant chamber also being in communication with the air passage means; and compensator means mounted in the lubricant chamber for separating the gaseous fluid from the lubricant, the compensator means being movable for limiting pressure differential between the air passage means and the lubricant chamber.

4. In an earth boring bit of the type having at least one rotatable cutter with a cavity for mounting on a depending bearing pin, the cutter and the bearing pin having a thrust bearing in an inner portion of the cavity and a set of roller bearings in an outer portion of the cavity, the improvement comprising:

air passage means for discharging through the roller bearings in the outer portion gaseous fluid pumped from the surface;

seal means between the bearing pin and the cutter for preventing the gaseous fluid from contacting the thrust bearing;

a lubricant chamber containing lubricant and formed in the bearing pin in communication with the thrust bearing, the lubricant chamber also being in communication with the air passage means; and a piston slidably mounted in the lubricant chamber for separating the gaseous fluid from the lubricant, the piston being movable in response to pressure differential between the air passage means and the lubricant chamber.

5. In an earth boring bit of the type having at least one rotatable cutter with a cavity for mounting on a depending bearing pin, the cutter and the bearing pin having a thrust bearing in an inner portion of the cavity and a set of roller bearings in an outer portion of the cavity, the improvement comprising:

air passage means for discharging through the roller bearings in the outer portion gaseous fluid pumped from the surface;

seal means between the bearing pin and the cutter for preventing the gaseous fluid from reaching the thrust bearing;

a lubricant chamber containing lubricant and formed in the bearing pin in communication with the thrust bearing, the lubricant chamber also being in communication with the air passage means;

a piston slidably mounted in the lubricant chamber for separating the gaseous fluid from the lubricant, the piston being movable in response to pressure differential between the air passage means and the lubricant chamber; and pressure relief means for discharging lubricant to the exterior should the pressure in the lubricant chamber exceed a selected maximum.

6. In an earth boring bit of the type having three rotatable cutters, each having a cavity inserted on a depending bearing pin, each cutter and bearing pin having mating thrust buttons at the bottom of the cavity, a radial load bearing immediately outward from the thrust buttons and a set of roller bearings at the entrance of the cavity, the bit further having an axial passage for discharging compressed air, the improvement comprising:

an air passage extending from the axial passage to the roller bearings for passing compressed air through the roller bearings to the exterior at the cavity entrance;

a lubricant chamber containing lubricant and extending from the air passage to the thrust buttons for supplying lubricant to the thrust buttons and the radial load bearing;

a sliding piston carried in the lubricant chamber, separating the lubricant from the compressed air, limiting pressure differential between the compressed air and the lubricant;

an O-ring seal located between the roller bearings and the radial load bearing for sealing the lubricant in the area of the thrust buttons and radial load bearing;

a relief passage in the bearing pin in communication with the lubricant chamber and extending to the exterior; and a pressure relief valve mounted in the relief passage for discharging lubricant to the exterior should the pressure in the lubricant chamber exceed a selected maximum.

* * * * *